United States Patent [19]

Bergmann et al.

[11] 4,336,065

[45] Jun. 22, 1982

[54] METHOD FOR THE MANUFACTURE OF A COMPOSITE MATERIAL BY POWDER METALLURGY

[76] Inventors: Hans Bergmann, Bruchbergweg 22, 3392 Clausthal-Zellerfeld; Rüdiger Bormann, Bühlstr. 2; Herbert C. Freyhardt, Auf der Wessel 65, both of 3400 Göttingen; Barry L. Mordike, Hüttenweg 1B, 3392 Clausthal-Zellerfeld, all of Fed. Rep. of Germany

[21] Appl. No.: 124,723

[22] Filed: Feb. 26, 1980

[30] Foreign Application Priority Data

Mar. 9, 1979 [DE] Fed. Rep. of Germany ..... 2909290

[51] Int. Cl.[3] ..... B22F 3/00

[52] U.S. Cl. ..... 75/200; 75/211

[58] Field of Search ..... 75/200, 206, 211

[56] References Cited

U.S. PATENT DOCUMENTS

| | | | |
|---|---|---|---|
| 3,070,440 | 12/1962 | Grant et al. | 75/206 |
| 3,525,609 | 8/1970 | Roberts | 75/206 |
| 3,552,954 | 1/1971 | McDonald, Jr. | 75/206 |
| 3,779,714 | 12/1973 | Nadkarni et al. | 75/206 |

*Primary Examiner*—Brooks H. Hunt

*Attorney, Agent, or Firm*—Kenyon & Kenyon

[57] ABSTRACT

A method for manufacturing a composite material by powder metallurgy wherein a starting material comprised of at least one body-centered cubic metal powder component, and contaminated by oxygen in its bulk or on its surface is mixed with a less noble supplemental component having a greater binding enthalpy for oxygen in powder form or as an alloy whereby the oxygen contaminant becomes bound to the supplemental component by internal solid-state reduction. The composite mixture is then deformed in at least one dimension to form ribbons or fibers thereof.

9 Claims, No Drawings

METHOD FOR THE MANUFACTURE OF A COMPOSITE MATERIAL BY POWDER METALLURGY

BACKGROUND OF THE INVENTION

The present invention relates generally to powder metallurgy. In particular, the invention relates to a method for manufacturing by powder metallurgy a composite material which is deformed in at least one dimension, which composite is formed from at least one and preferably two powder components, at least one of which is a body-centered cubic metal, and at least one of which may be contaminated with oxygen or an oxygen compound in its bulk or at its surface.

The manufacture of composite materials by powder metallurgy is known. Typically, two powder components, preferably two metal powders, are mixed, densified, extruded and drawn into wires by means of a deformation. In this manner, a composite material is produced in which the powder particles are drawn out into fibers, i.e., the composite fiber structure is deformed in two dimensions. If the composite material is deformed in only one dimension, the powder particles are drawn to form discontinuous ribbons.

In the manufacture of these composite materials, the two powder components are generally mixed, compacted, sintered and then subjected to the deformation process in which the powder particles are drawn out to form long fibers. However, particularly in the case of small powder particle sizes (less than or equal to 40 $\mu$m) of the powder components, oxygen is dissolved interstitially and/or at the surface as the corresponding oxide through reaction with atmospheric oxygen and/or oxygen present during the processing of the powder. The interstitially dissolved oxygen increases the hardness of a body-centered cubic powder component as well as the critical temperature of the ductile to brittle transition. As a consequence, a polyphase structure made powder-metallurgically by a sintering process cannot be transformed into the desired fiber structure during cold deformation because the hardened powder components do not allow this deformation to the degree desired. Indeed, these hardened components are present, in effect, as undeformed particles or as multiply-torn fiber segments in the other nonhardened powder component or components. The mechanical properties of such a composite material are unfavorable. In particular, the breaking stress of such composites is low (W. D. Jones, "Fundamental Principles of Powder Metallurgy," Arnold, London 1960; Metallische Verbundwerkstoffe (Metallic Composite Materials), Festschrift of the firm G. Rau, Pforzheim 1977; Series of the Powder Metallurgy Joint Group of the Iron and Steel Institute and the Institute of Metals, London).

It has already been attempted to purify an oxygen-contaminated, body-centered cubic powder component, particularly niobium, by reduction with hydrogen at temperatures of about 1000° C. However, the free binding enthalpies for interstitially dissolved oxygen and/or for the corresponding oxides, particularly in the case of transition metals, can amount to more than 100 (kcal/g-atom of oxygen) (at 25° C.). As a result, reducing the metal with either hydrogen, carbon monoxide or the like at temperatures of up to 1000° C. is often unsuccessful. (E. Fromm and E. Gebhardt, "Gase und Kohlenstoff in Metallen," Reine und angewandte Metallkunde in Einzeldarstellungen, Vol. 26, Springer Verlag Berlin 1976).

SUMMARY OF THE INVENTION

It is the object of the present invention to develop a method of the type described in such a manner that a ductile composite material can be manufactured thereby. In particular, if several powder components are used, the method should ensure that the components deform similarly.

According to the invention, this and other objects are achieved by adding to the powder component or components one or more comparatively less noble additive components with a comparatively greater binding enthalpy for the oxygen in powder form or as an alloy additive to one or several powder components, and binding the oxygen to this additive component by an internal solid-state reduction.

The invention thus proceeds in a manner not following the state of the art, according to which it had always been attempted to remove the oxygen from the composite material or to prevent, as far as possible, diffusion of further oxygen during the individual processing steps. The process of the invention binds the interstitially dissolved oxygen and/or the oxygen absorbed at the surface to the additive component by an internal solid-state reduction. The oxygen then remains in the composite material. Since the oxygen is no longer dissolved interstitially, being present as an oxide of the additive component, it no longer has a detrimental effect on the mechanical behavior of the powder components, especially those with the body-centered cubic lattice. Through the additive component, which has a comparatively greater binding enthalpy to oxygen than the other powder components of the composite, a successful and complete purification of oxygen from the powder component or components is possible. The method can be used to particular advantage if two or more powder components are employed.

The solid-state reduction is, as a rule, carried out at elevated temperature. This reaction takes place as an internal solid-state reduction during the annealing and/or sintering in the composite manufacturing process. A renewed reaction of the powder components with atmospheric oxygen is avoided in the process. With this procedure it is possible to mix and press powder components hardened by oxygen and, after the solid-state reduction, to transform them by cold deformation into a fiber structure. Additive components may also be employed which have only little or no solubility in the starting powder component or components.

The additive component is added in a small percentage to the composite materials, the content preferably being low enough that the composite material is only insignificantly hardened by precipitation of, or brought about by, the additive component. The solid-state reduction takes place in the bulk of the mixture of powder components and the additive component.

The method according to the invention is especially advantageous because of the simplicity of the manufacture of a composite fiber material, especially one of high density of extremely thin fibers and with high strength associated therewith. In particular, the method of this invention also applies to materials which heretofore could not be transformed into a fiber structure by deformation, due to their high affinity to oxygen.

First successful applications of this method led to the manufacture of superconductive composite fiber materials.

As one or several additive components, lanthanum, a lanthanide, calcium, beryllium, magnesium, lithium, hafnium, titanium, zirconium and/or aluminum can be used. Especially good experimental results are also obtained if copper and body-centered cubic niobium are used as powder components with 0.5 to 2.0% by weight aluminum powder as the additive component. Excellent properties are also obtained if copper and body-centered cubic vanadium are used as powder components with 2 to 10% by weight copper-calcium powder as the additive component.

DETAILED DESCRIPTION OF THE INVENTION

The invention will be illustrated further with the aid of two embodiment examples:

EXAMPLE 1

A niobium-copper composite fiber material is produced by mixing commercially available niobium powder (particle size $\leqq 20\mu m$) and copper powder as powder components in a weight ratio of 1:4 with the addition of 0.5 to 2.0% by weight of aluminum powder (particle size $\leqq 10\mu m$) and extruding at about 1050° C. In the process, the aluminum reacts with the oxygen introduced by the powder components, forming $Al_2O_3$, whereby the micro hardness ($H_v$) of the niobium powder is reduced from 3500 to 1000 or 1200 $N/mm^2$. Excess aluminum dissolves substitutionally in the copper. This equalizes the hardness and the ductility of the niobium and the copper. The composite material can subsequently be transformed by cold deformation (rolling, swaging, wire drawing) into a ribbon-shaped or a fiber structure. Depending on the size of the powder and the degree of deformation fiber thickness of less than 100 nm are obtained. Breaking of the fibers during the deformation is not observed.

Magnesium powder or calcium alloy powder can also be used as the additive component instead of the aluminum powder.

EXAMPLE 2

A vanadium-copper composite fiber material is produced by mixing vanadium power (particle size $\leqq 20\mu m$) with copper powder in a ratio of 1:2 with the addition 2 to 10% by weight copper-calcium powder. The mixture is subsequently extruded at 1000° C., reducing the oxygen content in the vanadium from about 3% to less than 0.1% (atomic %). Non-oxidized calcium is precipitated as $Cu_5Ca$. The subsequent deformation of the structure leads to a vanadium-copper composite fiber wire.

Here, too, aluminum and/or magnesium powder can be used as the additive component.

What is claimed is:

1. A method for manufacturing a composite material by powder metallurgy, comprising the steps of:

(a) forming a mixture of:

(1) a starting material comprised of at least one body-centered cubic metal powder component, said starting material being contaminated within or on its surface with oxygen or an oxygen compound; and (2) at least one additive component which is an unoxidized metal having in powder form or as an alloy a greater binding enthalpy for oxygen than said starting material; and (b) processing said mixture to form a composite wherein the presence of said additive component results in the binding therewith by internal solid-state reduction of the oxygen contaminating said starting material; and (c) deforming said composite in at least one dimension.

2. The method according to claim 1 wherein said starting material is comprised of at least one body-centered cubic metal powder contaminated within or on its surface with oxygen or an oxygen compound and at least one additional powdered component.

3. The method according to claim 2 wherein said starting material comprises body-centered cubic niobium and copper.

4. The method according to claim 3 wherein said additive component is present in an amount of from about 0.5 to 2.0% by weight of the starting material.

5. The method according to claim 4 wherein said additive component is aluminum powder.

6. The method according to claim 2 wherein said starting material comprises body-centered cubic vanadium and copper.

7. The method according to claim 6 wherein said additive component is present in an amount of from about 2.0 to 10% by weight of the starting material.

8. The method according to claim 7 wherein said additive component is copper-calcium powder.

9. The method according to claim 1 wherein said additive component is at least one component selected from the group consisting of lanthanum, a lanthanide, calcium, beryllium, magnesium, lithium, hafnium, titanium, zirconium and aluminum.

* * * * *